US006296496B1

(12) United States Patent
Trammel

(10) Patent No.: US 6,296,496 B1
(45) Date of Patent: Oct. 2, 2001

(54) ELECTRICAL CONNECTOR AND METHOD FOR ATTACHING THE SAME TO A PRINTED CIRCUIT BOARD

(75) Inventor: John D. Trammel, Winston-Salem, NC (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/640,904

(22) Filed: Aug. 16, 2000

(51) Int. Cl.[7] ..... H01R 12/00
(52) U.S. Cl. ..... 439/79
(58) Field of Search ..... 439/79, 80, 637, 439/60, 108, 608, 701, 731, 607, 696

(56) References Cited

U.S. PATENT DOCUMENTS 4,678,250 * 7/1987 Romine et al. ..... 439/83
4,806,110 * 2/1989 Lindeman ..... 439/108
4,920,074 * 4/1990 Shimizu et al. ..... 29/827
5,085,595 * 2/1992 Koegel et al. ..... 439/494
5,294,039 * 3/1994 Pai et al. ..... 228/180.22
5,577,936 * 11/1996 Hahn ..... 439/607
5,897,386 * 4/1999 Baxter et al. ..... 439/79
6,059,608 * 5/2000 Benes ..... 439/620

* cited by examiner

*Primary Examiner*—Tulsidas Patel
(74) *Attorney, Agent, or Firm*—Wei Te Chung

(57) ABSTRACT

An electrical connector (1) comprises a die-cast metal housing (10) and a pair of terminal inserts (40) received in the housing. Each terminal insert includes a first terminal core (401) and a second terminal core (402), each terminal core having a plurality of signal contacts (20) insert-molded therein. A pair of ground plates (30) is sandwiched between the first and second terminal cores. Each ground plate forms a plurality of ground tails (31) extending out of the housing and alternatingly bending upwardly and downwardly to form a space for straddle mounting a PCB (2) therebetween. The signal contacts have contact tails (25) coplanar with the ground tails for straddle mounting to the PCB. The PCB forms a plurality of signal pads (55) and ground pads (57) both on an upper face (52) and a lower face (54) thereof for respectively electrically engaging with the signal contacts and the ground plates.

3 Claims, 5 Drawing Sheets

ELECTRICAL CONNECTOR AND METHOD FOR ATTACHING THE SAME TO A PRINTED CIRCUIT BOARD

FIELD OF THE INVENTION

The present invention relates to an electrical connector, and particularly to an electrical connector with grounding tails which are coplanar with the solder tails of terminals thereof. The present invention further relates to a method for attaching the connector to a printed circuit board.

BACKGROUND OF THE INVENTION

Interconnect systems that are electrically invisible are popularly needed for transmitting high-speed signals. Greatest concentration has been put on Ground-Signal-Ground configurations for differential applications. To achieve an invisible connector system, connector systems have been developed for straddle and vertical mount applications.

An example of a prior art electrical connector is illustrated in U.S. Pat. No. 5,199,885. As shown in FIGS. 4 and 5, an electrical connector comprises two rows of terminals 10 defining a space therebetween for receiving a circuit board 12. The terminals 10 engage with conductive pads 14 formed on the circuit board 12 to establish electrical connection between the connector and the circuit board 12. A plurality of through holes 16 are defined in the circuit board 12 proximate and spaced along an edge 18 of the circuit board 12 received in the space between the terminals 10. Each through hole 16 has an inner plating electrically connected to a grounding path of the circuit board 12. The connector has a plurality of grounding pins 20 arranged in the space between the terminals 10 for extending through the edge 18 of the circuit board 12 to intersect the corresponding through holes 16 to electrically engage the plating, thereby grounding the pins 20 to the circuit board 12.

This connector establishes a grounding engagement with the circuit board 12 via the engagement between the grounding pins 20 and the plating in the through holes 16. Since the holes 16 are close to the edge of the printed circuit board 12, slits bridging the holes 16 and the edge have to be cut before the connector is attached to the printed circuit board.

Furthermore, the process of connecting the grounding pins 20 with the through holes 16 of the circuit board 12 via the slits is complicated.

Additionally, pre-machining the edge 18 of the circuit board 12 to establish slits for insertion of the grounding pins increases the overall cost of assembly.

BRIEF SUMMARY OF THE INVENTION

A main object of the present invention is to provide an electrical connector having contacts and ground tails which are arranged in a straddle-mount configuration for easy integration with a printed circuit board (PCB).

Another object of the present invention is to provide an electrical connector having a simplified manufacture and reduced cost.

A further object of the present invention is to provide a method to conveniently mount (or assemble) the connector to a PCB while ensuring a reliable signal transmission.

An electrical connector according to the present invention comprises a die-cast metal housing and a pair of terminal inserts assembled in the housing. Each terminal insert includes a first and a second terminal cores, and a ground plate sandwiched between the first and second terminal cores. Each of the first and second terminal cores has a plurality of signal contacts insert-molded therein. The ground plates are horizontally aligned with each other. Each ground plate forms a plurality of ground tails extending out of the housing and alternatingly bending upwardly and downwardly to form a space for straddle mounting to a PCB. Each signal contact has a contact tail coplanar with a ground tail. The signal contacts in first and second terminal cores face each other for mounting the PCB therebetween.

The PCB forms a plurality of signal pads and ground pads on both an upper and a lower faces thereof. The PCB has an edge connecting the upper and the lower faces thereof, allowing the connector to be straddle mounted to the edge, the contact tails and the ground tails being engaged with upper and lower faces of the PCB.

Other objects, advantages and novel features of the invention will become more apparent from the following detailed description when taken in conjunction with the accompanying drawings.

DETAILED DESCRIPTION OF INVENTION

Figure 1:
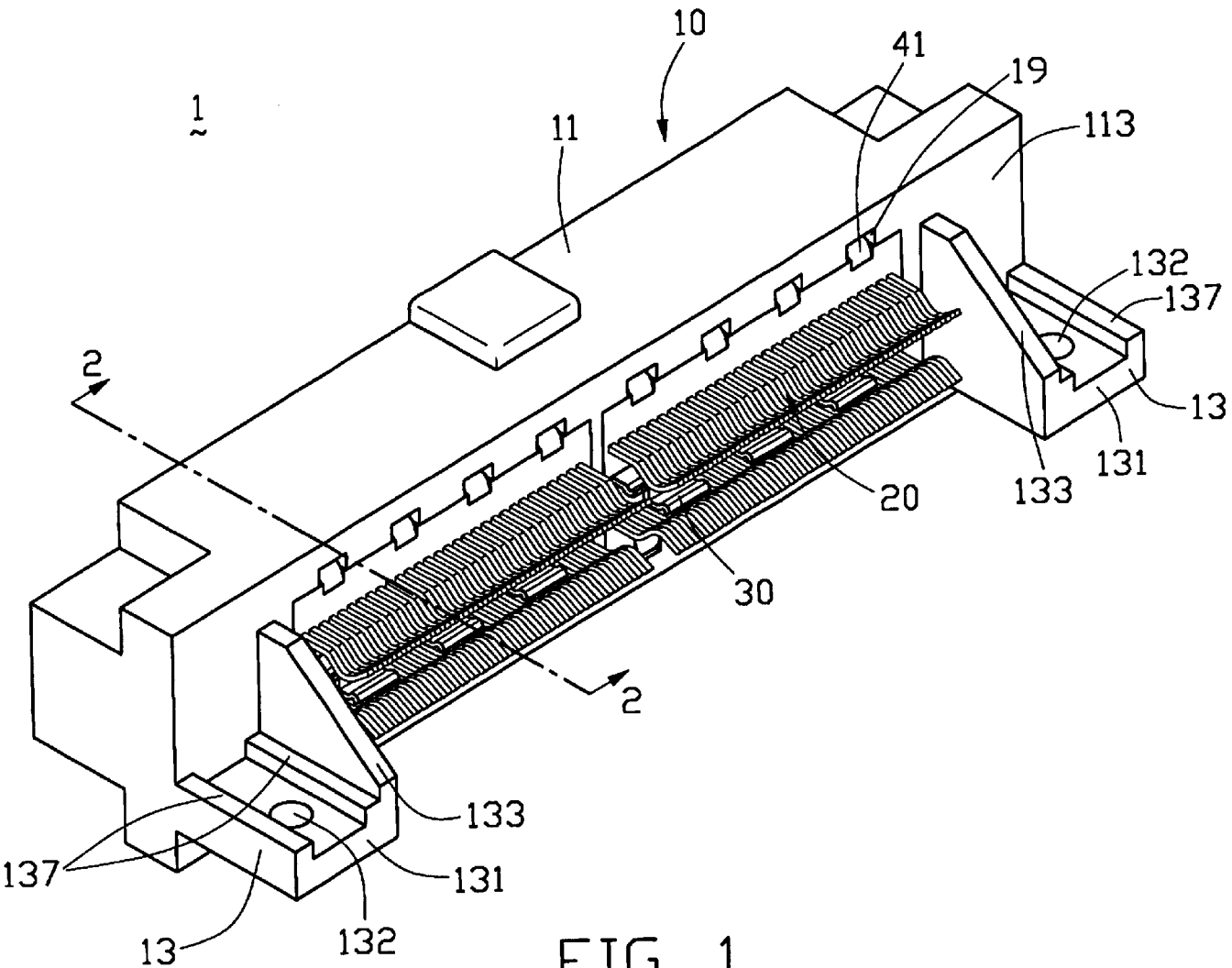
FIG. 1 is a perspective view of an electrical connector in accordance with the present invention.
Figure 2:
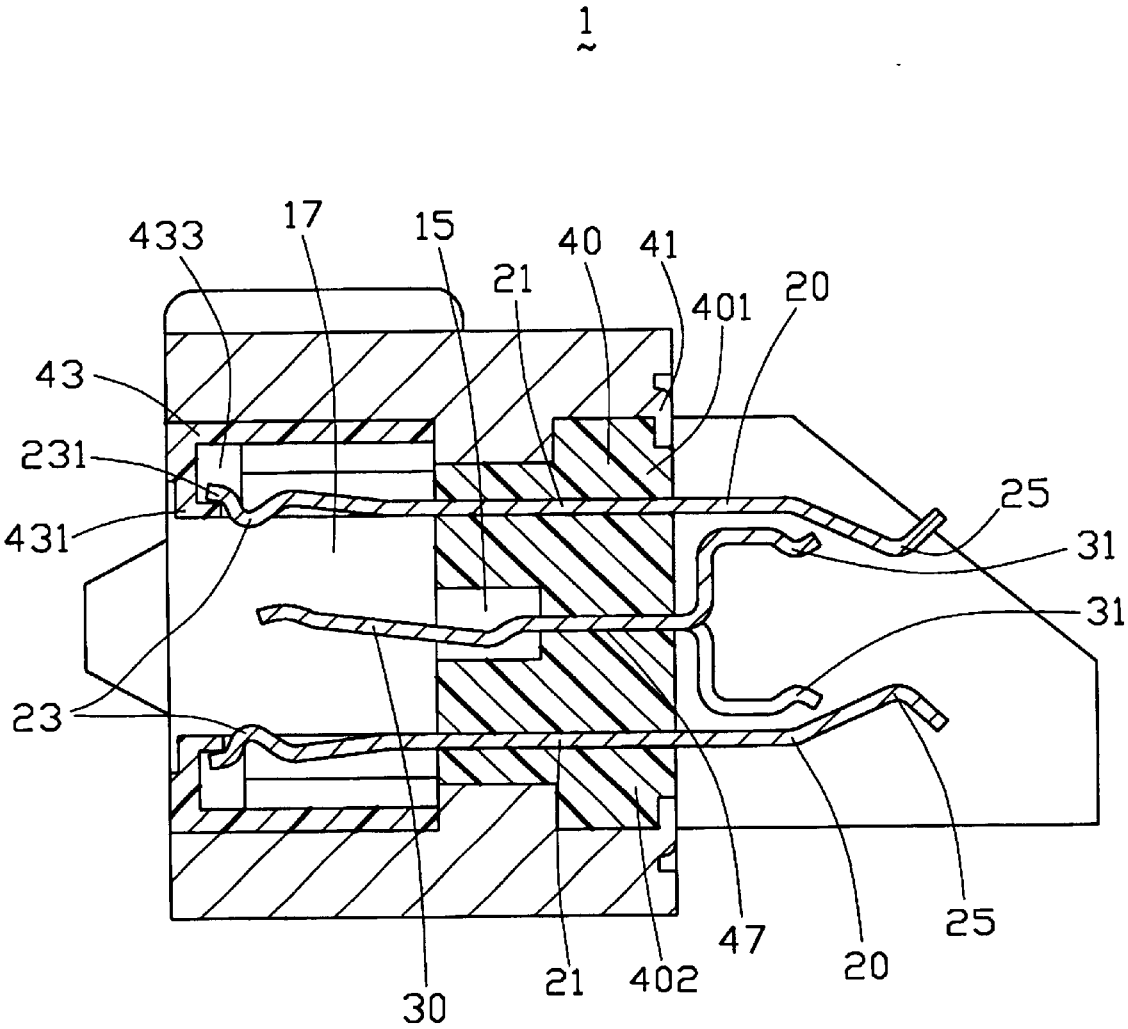
FIG. 2 is a cross-sectional view of an electrical connector taken along line 2—2 of FIG. 1.
Figure 3:
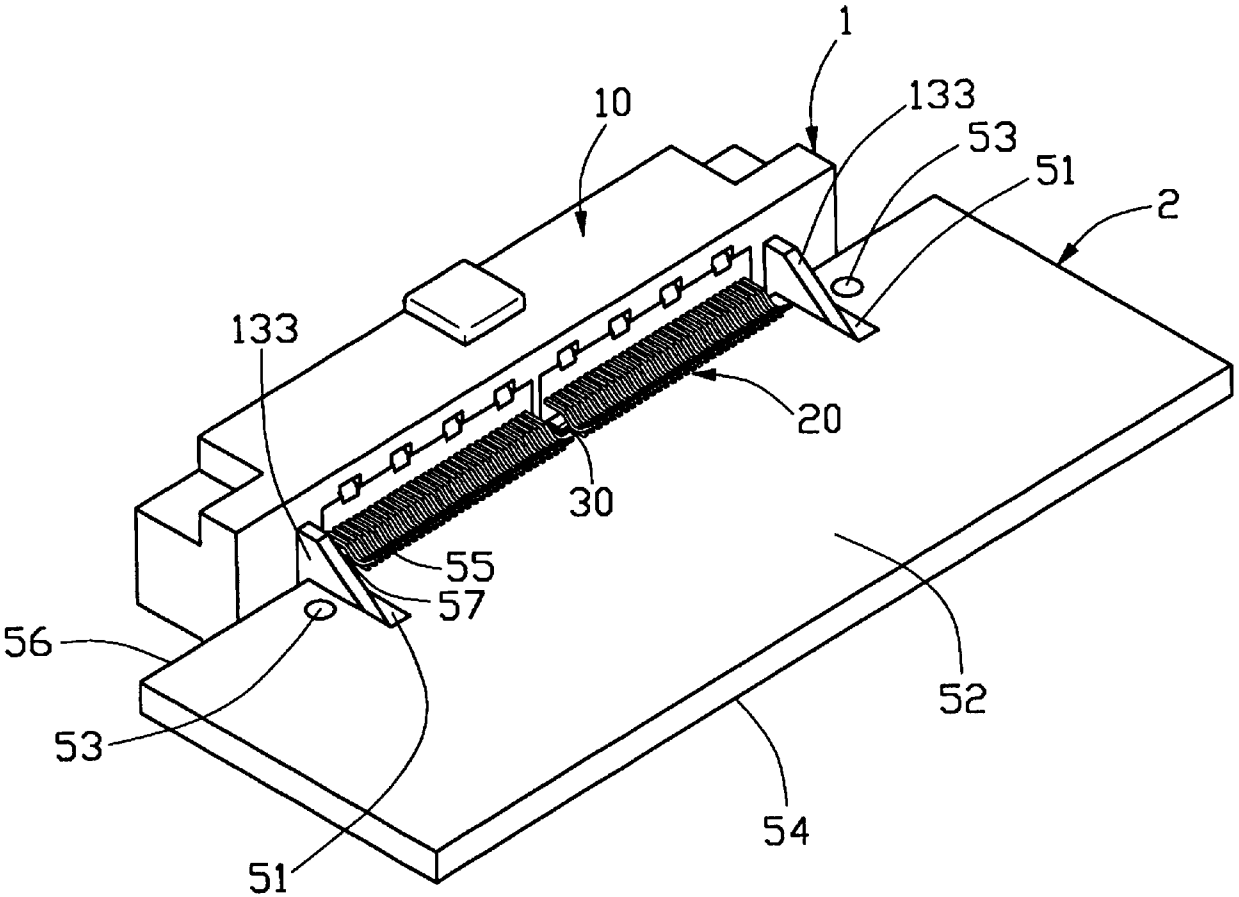
FIG. 3 is an assembled view of the electrical connector mounted to a PCB.
Figure 4:
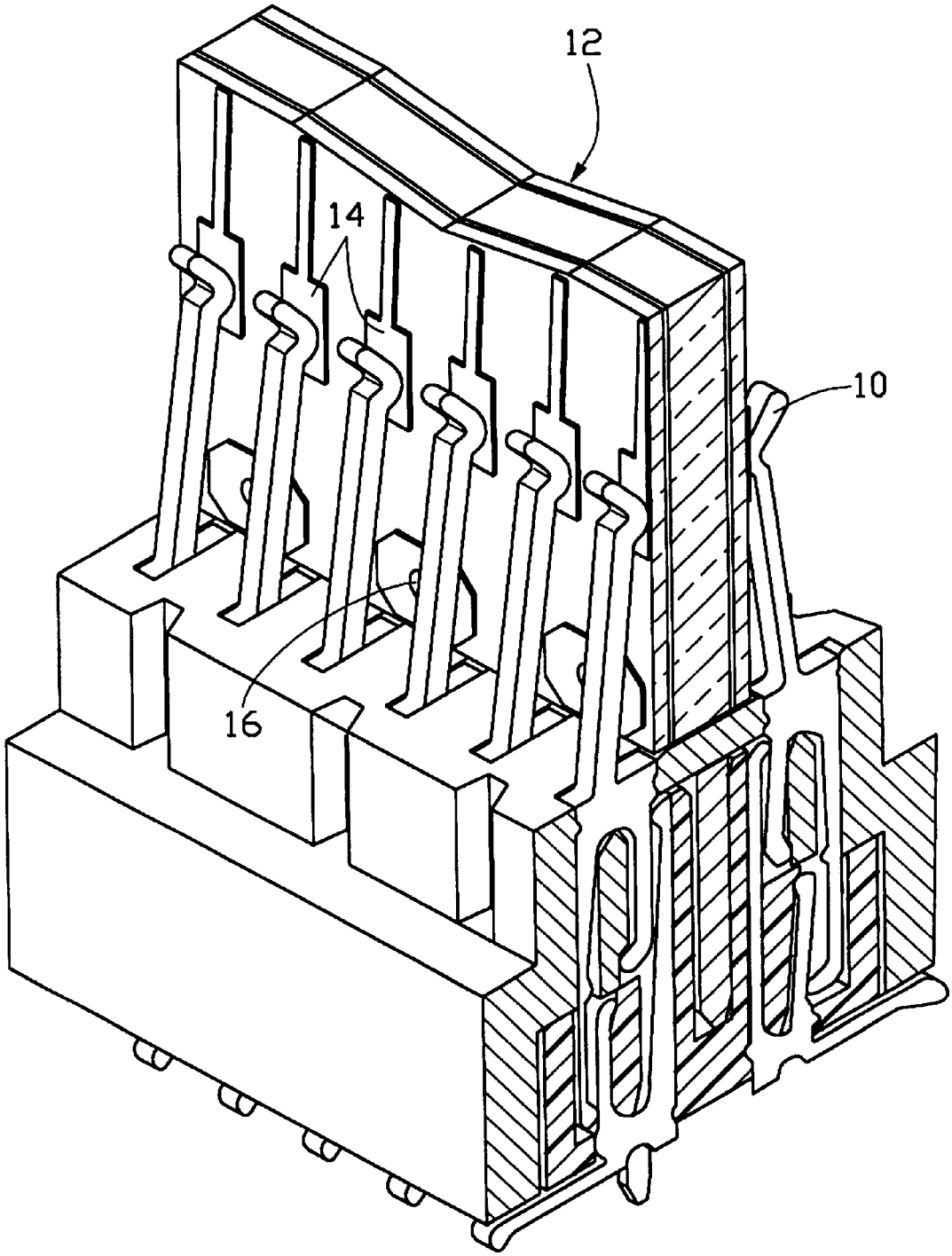
FIG. 4 (PRIOR ART)
FIGS. 4 is a fragmentary perspective view of a conventional matched impedance connector with a portion of a PCB.
Figure 5:
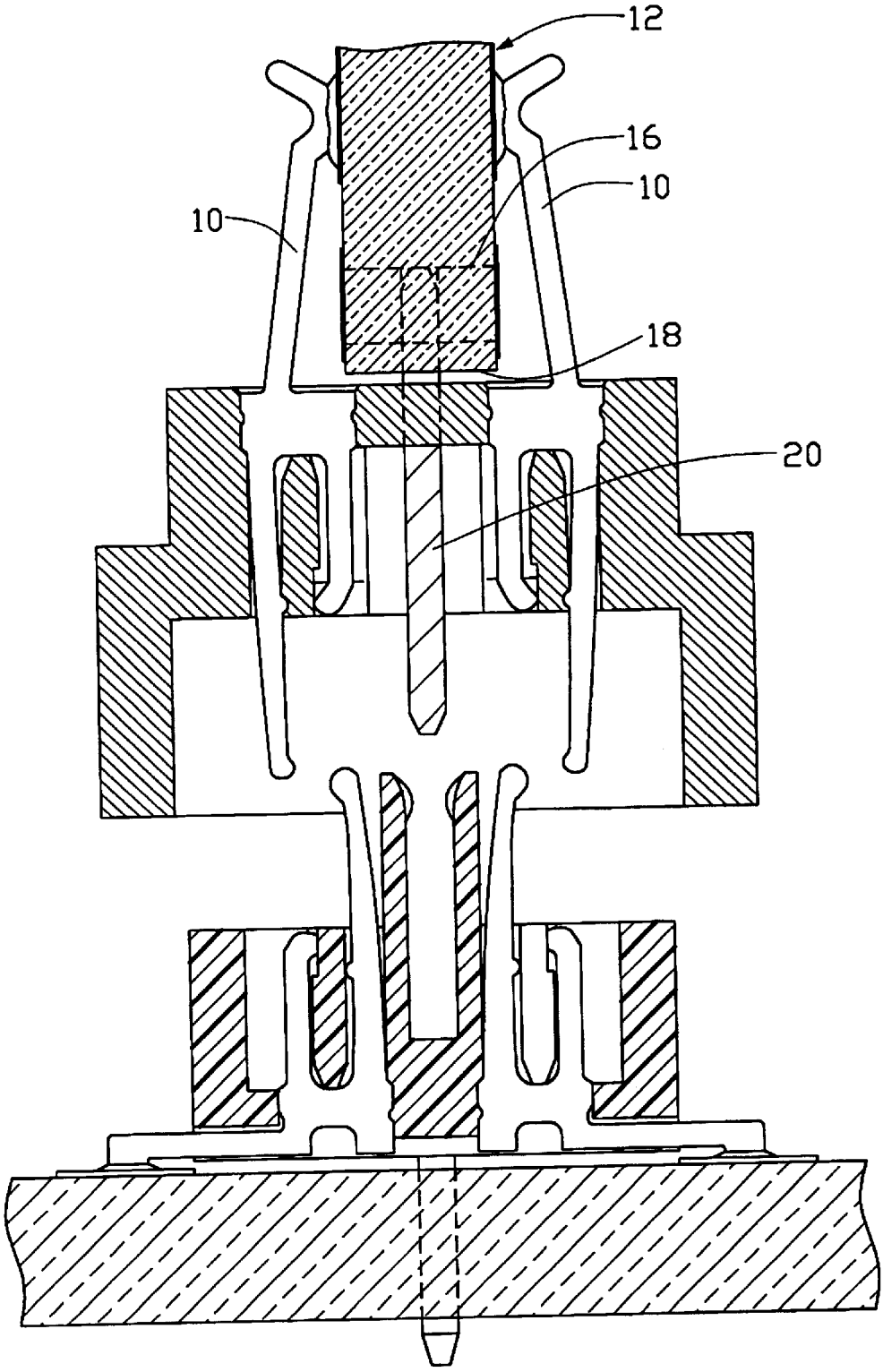
FIG. 5 (PRIOR ART)
FIGS. 5 is a cross-sectional view of the conventional matched impedance connector and a PCB about to mate with a complementary connector mounted on a substrate.

Referring to the drawings and in particular to FIGS. 1 and 2, a matched impedance connector 1 according to the present invention comprises a die-cast metal housing 10 and a pair of terminal inserts 40 assembled in the housing 10, the terminal inserts 40 having a plurality of signal contacts 20 insert molded therein.

The housing 10 comprises substantially an elongated main body 11 defining two first cavities 15 separated from but aligned with each other and two second cavities 17 each in communication with a respective one of the first cavities 15. Each first cavity 15 accommodates a terminal insert 40 engaged therein. Each terminal insert 40 comprises a first and a second terminal cores 401, 402 stacked together, and a ground plate 30 sandwiched therebetween. Each of the terminal cores 401, 402 has a plurality of signal contacts 20 insert-molded therein. A plurality of recesses 19 is defined in a rear surface 113 of the main body 11. Each recess 19 has a latch 41 projecting from an inward face thereof.

A pair of insulative mounting plates 43 is respectively held in each second cavity 17, abutting against top and bottom sides of the second cavity for positioning the signal contacts 20. Each mounting plate 43 forms an L-shaped hook 431 at a front end thereof, thereby defining a cutout 433 exposed rearwardly toward the corresponding first cavity 15.

A pair of board locks 13 rearwardly projects from opposite sides of the rear surface 113 of the main body 11. Each board lock 13 includes a base 131 and a triangular supporting plate 133 substantially perpendicular to the base 131. A pair of shoulders 137 extends longitudinally along opposite sides of the base 131 for abutting a lower face of a printed circuit board (PCB) 2 when the connector 1 is assembled onto the PCB 2. Preferably, a circular first hole 132 is defined between the shoulders 137 of each board lock 13.

In an assembled connector 1, the signal contacts 20 are arrayed in two rows, facing each other for electrically connecting the PCB 2 therebetween. Each signal contact 20 comprises an elongated beam 21 having a contact portion 23 and a contact tail 25 respectively extending from opposite ends of the elongated beam 21. The contact portion 23 extends into the second cavity 17 and has a tip end 231 bent outwardly. The contact tail 25 extends beyond the rear surface 113 of the main body 11 and has a convex end which substantially faces the contact tail 25 of a corresponding signal contact 20.

When each first and second terminal core 401, 402 is stacked together, a ground plate 30 is sandwiched in a slit 47 therebetween. In an assembled connector 1, the ground plates 30 horizontally align with each other. Each ground plate 30 forms a plurality of ground tails 31 extending out of the housing 10 and alternatingly bending upwardly and downwardly to form a space for receiving the PCB 2 therebetween. Each ground tail 31 is formed in a substantially L-shape and has a distal end arrayed coplanar with contact tails 25 in a direction parallel to a face of the inserted PCB 2. A proximal end of each ground tail 31 is substantially bent vertically towards the plane of the ground plate 30, providing the ground tail 31 with a certain degree of resiliency.

Each terminal insert 40 is assembled in a corresponding cavity 15 in the housing 10. Then the latches 41 are deformed inwardly to lock the terminal inserts 40 into the housing 10. The tip end 231 of each signal contact 20 is extended into the cutout 433 of the corresponding mounting plate 43 and abuts the hook 431 thereof.

The PCB 2 comprises an upper face 52 and a lower face 54 on which conductive traces, including signal pads 55 and ground pads 57, are formed. The PCB 2 has an edge 56 connecting the upper and lower faces 52, 54, through which a pair of slots 51 is cut for respectively locking the supporting plates 133 of the board locks 13. A pair of second holes 53 is defined adjacent to the edge 56 for cooperating with the first holes 132 in the housing 10, whereby extra devices can be used to attach the connector 1 to the PCB 2, if desired.

Before the assembly of the connector 1 to the PCB 2, solder paste is applied to the signal pads 55 and ground pads 57 on the PCB 2. Then the solder paste is reflowed and then is solidified as solder balls/blocks on the signal pads 55 and the ground pads 57. The PCB 2 is then inserted between the two rows of signal contacts 20 and ground tails 31, the contact tails 25 contacting the corresponding signal pads 55 and the ground tails 31 contacting the corresponding ground pads 57 so that the ground plates 30 straddle mount the PCB 2 at the edge 56. Then the solder balls are again reflowed and then are solidified as soldered connection between the contact tails 25 and the signal pads 55 and between the ground tails 31 and ground pads 57.

Although the contact tails 25 scrape over the ground pads 57 to arrive at their designated the signal pads 55 during mounting of the connector 1 to the PCB 2, the solder paste on the ground traces 57 is not removed. It is because the solder paste has been reformed to be the solder balls securely attached to the corresponding ground pads 57 rather than the pure solder paste which may be easily scraped, by the contact tails 25, from the ground pads 57 thereunder. Thus, dependable connections between the ground plates 30 and the ground pads 57 is obtained due to the solder paste being properly stabilized prior to fitting the connector 1 to the PCB 2.

By straddle mounting the connector 1 to the PCB 2 via soldering, the steps involving machining of the edge of the PCB 2 in the prior art design are omitted, thereby reducing costs. Additionally, the pitches of the signal contacts 20 and ground plates 30 are very small, presenting a difficult soldering problem. However, the problem is solved by reflowing the solder paste twice.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector system comprising:

a PCB forming signal pads and ground pads both on an upper face and a lower face; and an electrical connector mounting to an edge of the PCB, comprising:

a die-cast metal housing defining at least a cavity therethrough and forming a pair of boardlocks rearwardly projecting from opposite sides of a rear surface thereof, each boardlock including a base and a triangular supporting plate substantially perpendicular to the base;

a terminal insert being accommodated in the cavity, wherein said terminal insert comprises a plurality of signal contacts being respectively received in a first and a second terminal cores and being suitable for electrically connecting with the signal pads on the PCB, each signal contact including a contact tail extending from an end thereof to be straddle mounted to the PCB; and a ground plate being sandwiched between said first and second terminal cores and including a plurality of ground tails coplanar with the contact tails and extending out of the housing to be straddle mounted to the PCB and to engage with the ground pads; wherein before the connector and the PCB are assembled together in a front-to-back direction, a solder paste is applied to each of said signal and ground pads and deformed to be a corresponding solder ball via a reflowing procedure.

2. The electrical connector system as claimed in claim 1, wherein a pair of shoulders extends longitudinally along opposite sides of the base for abutting the lower face of the PCB when the connector is assembled onto the PCB.

3. The electrical connector system as claimed in claim 2, wherein the PCB defines a pair of slots through an edge thereof for respectively receiving the supporting plates of the board locks.

* * * * *